US005118542A

United States Patent [19]

McLeod

[11] Patent Number: 5,118,542

[45] Date of Patent: Jun. 2, 1992

[54] ASSEMBLY OF ARTICULATED MEMBERS FOR FORMING A SURFACE

[76] Inventor: Warren H. McLeod, 566 Parker Ave., Brick, N.J. 08724

[21] Appl. No.: 566,834

[22] Filed: Aug. 13, 1990

[51] Int. Cl.[5] ..... E04C 1/30; B32B 3/06

[52] U.S. Cl. ..... 428/33; 428/54; 428/138; 428/36.9; 52/177; 404/35; 404/36; 404/37

[58] Field of Search ..... 428/53, 54, 33, 36.9, 428/138; 404/35, 37, 36; 52/177

[56] References Cited

U.S. PATENT DOCUMENTS

| | | | |
|---|---|---|---|
| 305,328 | 9/1884 | Peck | 404/37 |
| 3,595,140 | 7/1971 | Lundin | 94/4 |
| 3,685,403 | 8/1972 | Domnick | 52/588 |
| 3,820,912 | 6/1974 | Hughes | 404/35 |
| 3,912,408 | 10/1975 | Domnick | 404/35 |
| 3,999,879 | 12/1976 | Stachiw et al. | 404/73 |
| 4,047,257 | 9/1977 | Bondarchuk | 404/35 |
| 4,654,245 | 3/1987 | Balzer et al. | 428/52 |
| 4,681,482 | 7/1987 | Arciszewski et al. | 404/35 |
| 4,766,020 | 8/1988 | Ellingson, Jr. | 428/54 |
| 4,804,570 | 2/1989 | Bedics | 428/53 |

OTHER PUBLICATIONS

Leichtung Workshops (catalogue), Mar. 1989.

*Primary Examiner*—Alexander S. Thomas
*Attorney, Agent, or Firm*—Mathews, Woodbridge & Collins

[57] ABSTRACT

A plurality of rigid bars, made of wood, plastic or other material, are joined together to form an articulated assembly. A rope is threaded through bores formed in the bars. Cylindrical spacers are placed over the rope between the bars. In an alternate embodiment, flexible interlocking elements are connected to bores formed in the bars. When laid flat over a surface, the articulated assembly may be used as a support that forms a deck, walkway, or similar structure. Other uses of the assembly include a latticework, a barrier and a vertical support.

11 Claims, 7 Drawing Sheets

ASSEMBLY OF ARTICULATED MEMBERS FOR FORMING A SURFACE

BACKGROUND OF THE INVENTION

1. Field of the Invention

The present invention relates to flexible surfaces for use as walkways, roadways, support barriers or the like and, more particularly, to a system of articulated rigid members that may be mounted to form a surface.

2. Description of the Prior Art

In the past, it has been the general practice to employ various assemblies of inter-linked members for covering a strip of ground to provide a temporary or emergency path. Typically, such assemblies comprise a number of rigid members flexibly linked by means of a flexible rope on which the members are threaded or by means of interlocking elements that are attached to and extend between adjacent members. The flexibility of the rope and the interlocking elements enable the assemblies to be laid on an uneven strip of ground or other surface and to be rolled up for storage or for moving them about. Examples of such prior art assemblies may be found in the following U.S. Pat. Nos.: 3,685,403; 3,595,140; 4,681,482; 4,047,257; and 3,912,408. Similar articulated structures used as doormats may be found in U.S. Pat. Nos. 4,766,020; 4,804,570; and 4,654,245. A catalogue by Leichtung Workshops, March 1989, shows a flexible doormat made of wooden slats and spacers that are held together with a polypropylene rope.

Although such prior art devices have served the purpose, they have not been widely used by the general public for a variety of reasons. Many prior art devices are designed to be used in only a highly specialized environment. Others incorporate complex combinations of elements making them expensive to manufacture, cumbersome to assemble and disassemble, and difficult to repair and maintain. While there has been a long recognized need for improvements in the design of such structures, no practical device has yet been devised that resolves many of the current shortcomings. Ideally, a portable supporting surface would be manufactured from a combination of simple elements, be easy to assemble and disassemble, be collapsible into a compact configuration for moving and storage, be easy to clean, and be capable of assuming a variety of shapes so that it may be safely used over irregular surfaces, may be made to follow a winding path or may be positioned on its edge to form a stable support or barrier. The present invention fulfills this need.

SUMMARY OF THE INVENTION

The general purpose of this invention is to provide a portable structure for use as a temporary path, doormat, deck, support, barrier or the like which embraces all the advantages of similarly employed devices while avoiding many of their disadvantages. To attain this, one aspect of the present invention contemplates a unique combination of rigid bars and spacers threaded on a rope. Another aspect of the invention contemplates a plurality of rigid bars held together by interlocking elements. In all aspects of the invention, the portable structure is formed from a combination of elements that are simple to manufacture and that may be easily assembled and disassembled by a typical user. Additionally, the elements that form the present invention may be combined during manufacture or at a later time by the user to form a specific configuration that lays flat or can turn corners to follow a winding path or may be stood on its edge to act as a support or barrier.

The exact nature of this invention as well as other objects and advantages thereof will be readily apparent from consideration of the following specification relating to the annexed drawings.

DETAILED DESCRIPTION OF THE PREFERRED EMBODIMENT

Figure 1:
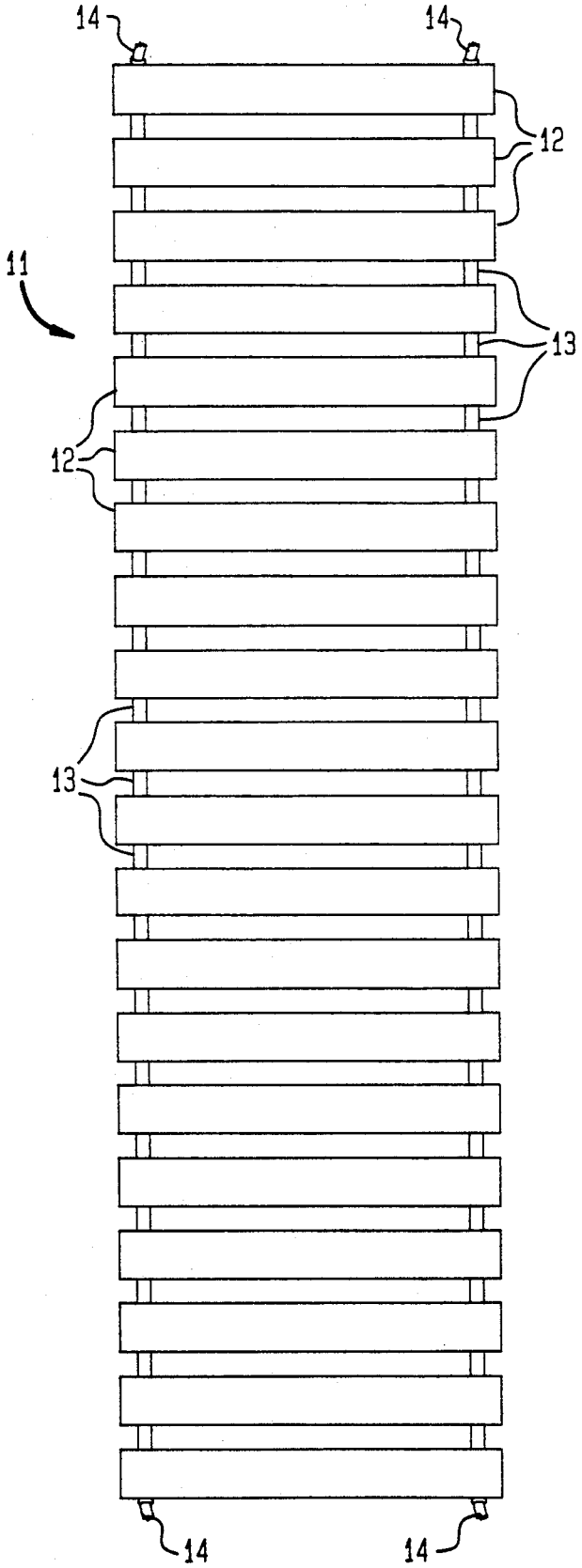
FIG. 1 is a top plan view of a preferred embodiment of the invention.
Figure 2:
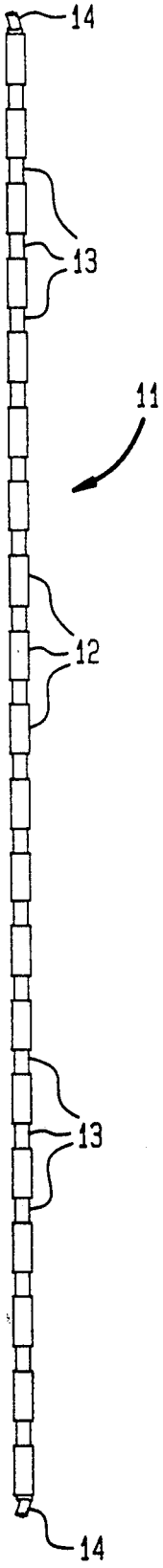
FIG. 2 is a side elevation of the device shown in FIG. 1.

Referring now to the drawings, there is shown in FIGS. 1–4 an assembly 11 composed of a plurality of rigid bars 12, a plurality of spacers 13 and two ropes 14. The bars 12, which may be fabricated from a variety of materials including wood and plastic, generally have rectangular cross-sections and are held in a spaced parallel relation with respect to each other by the spacers 13 and the flexible ropes 14.

Figure 3:
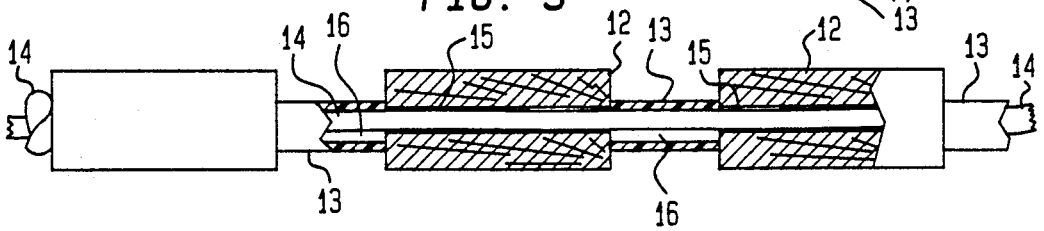
FIG. 3 is a broken-away section of a portion of the device shown in FIG. 2.

As seen in FIG. 3, the bars 12 have bores 15 through which the ropes 14 are threaded. Likewise, the spacers 13, formed as thin-walled plastic cylinders, have bores 16 for receiving the ropes 14. When the elements of the assembly 11 are threaded together, the ropes 14 are preferably pulled taut and knotted at their ends to lightly hold the bars 12 into abutting engagement with the spacers 13. Of course, depending upon the characteristics of the ropes 14, the assembly 11 may eventually become loose due to wear resulting in a permanent stretching of the ropes 14. Although a slack rope 14 will usually have no noticeable effect on the operation of the assembly 11, the loose condition may be rectified by simply removing the slack from ropes 14 by pulling them taut and reknotting their ends.

Figure 5:
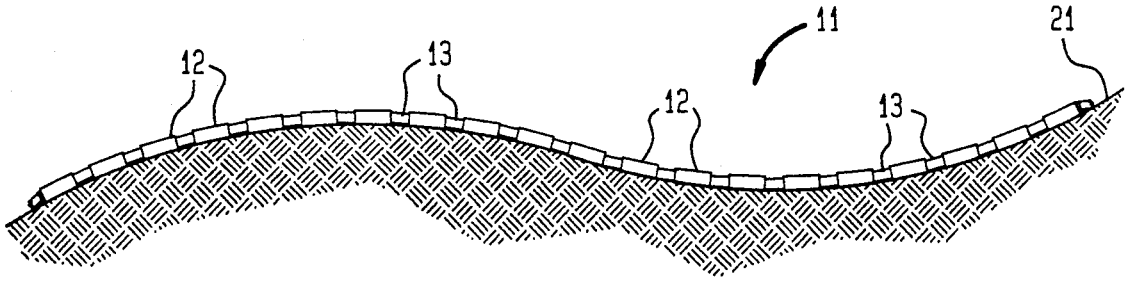
FIG. 5 is an elevation of the preferred embodiment in use on an irregular surface.

It is contemplated that the ropes 14 be sufficiently elastic to permit the assembly 11 to generally follow the contours of an irregular surface when superimposed thereon. FIG. 5 illustrates positions assumed by the bars 12 and spacers 13 when the assembly 11 lies on an irregular surface 21. The elasticity of rope 14 permits the assembly 11 to assume this position. This feature is important since it is contemplated that the assembly 11 be capable of safely acting as a semi-rigid walkway on such surfaces as mud, sand, gravel, etc. These irregular surfaces are typically found at beach areas, recreational camping sites, parks, and the like. It is contemplated that the assembly 11 may also be employed as a vertical barrier in gardens to protect plants or at beach areas to protect sand dunes and the like from damage.

Figure 6:
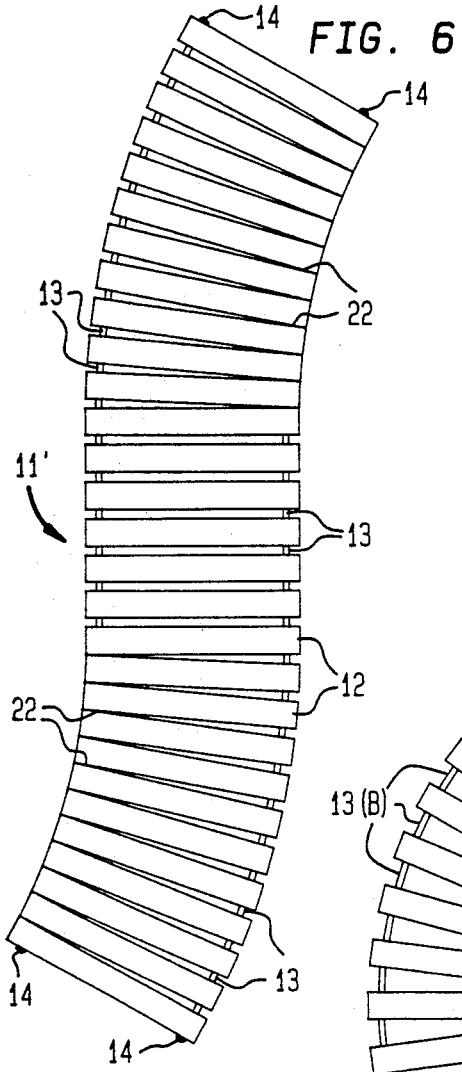
FIGS. 6 and 7 are top plan views of modifications of the preferred embodiment of FIG. 1.
Figure 7:
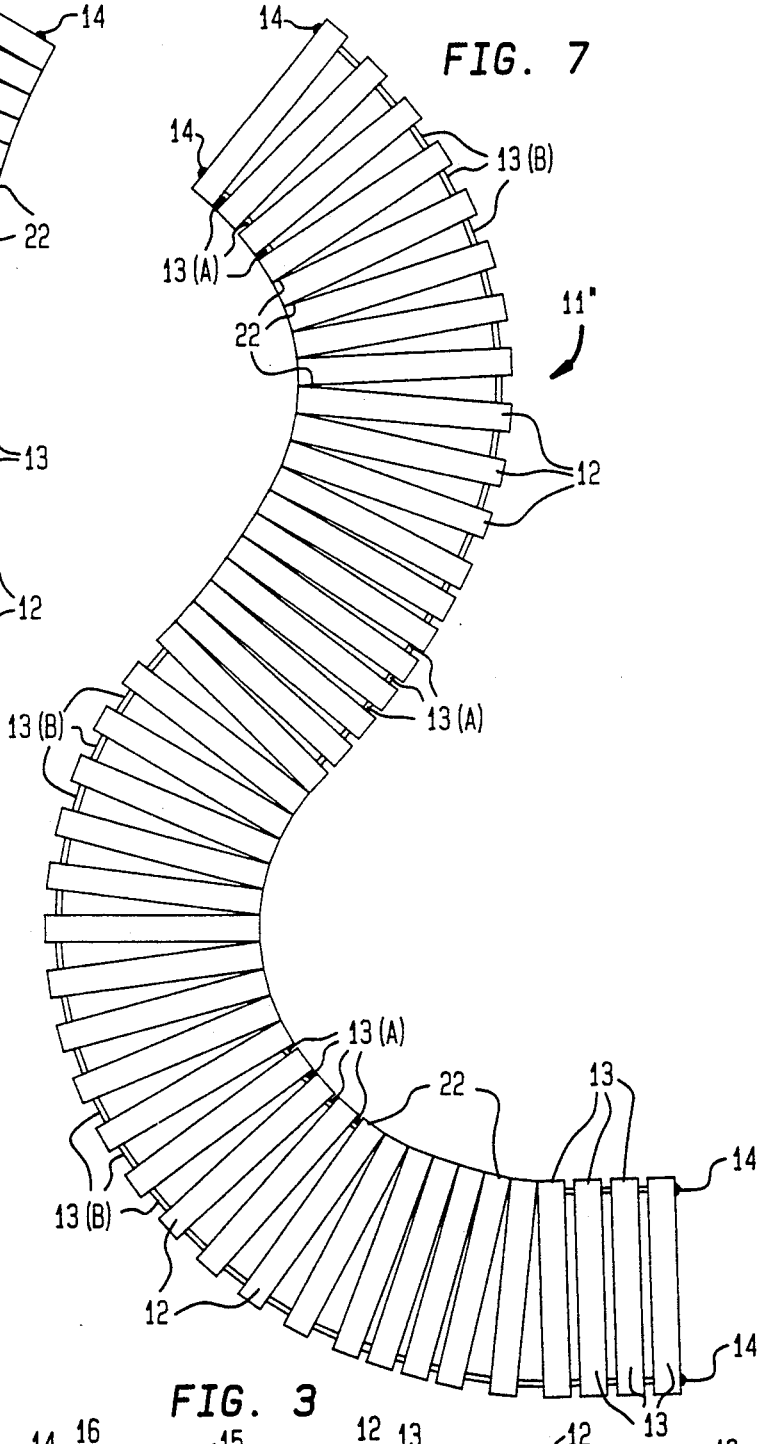

FIGS. 6–7 illustrate yet another important feature of the assembly 11. In the FIG. 6 modification, selective ones of the spacers 13 have been removed, thereby causing one side of the bars 12 to abut each other at the points 22. This modification of the assembly 11 will cause it to assume a curved shape. By selectively removing a sufficient number of spacers 13, the assembly 11 can be made to turn through any desired angle. The rate of curvature may also be adjusted, as seen in FIG. 7, by simply inserting smaller sized spacers 13(A) at one side and/or by inserting larger sized spacers 13(B) at the other side. FIG. 7 illustrates the assembly 11 having various turns using short spacers 13(A), larger spacers 13(B) and regular spacers 13.

Figure 10:
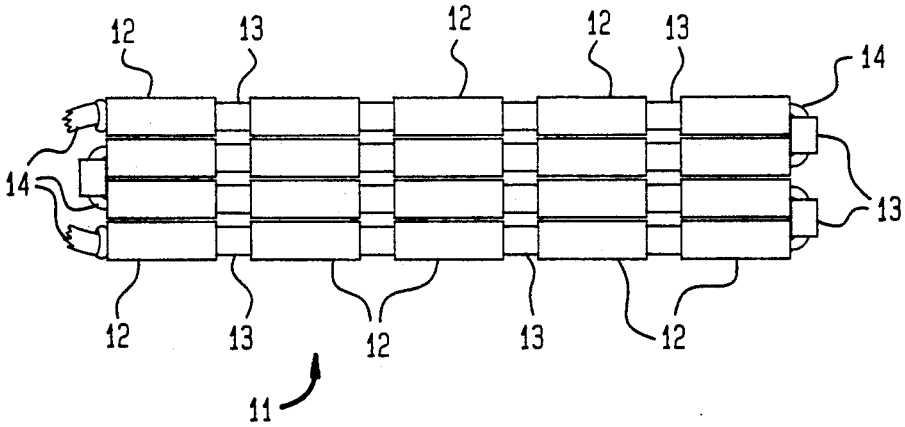
FIGS. 9 and 10 are side elevations of a portion of the preferred embodiment in a collapsed configuration.
Figure 9:
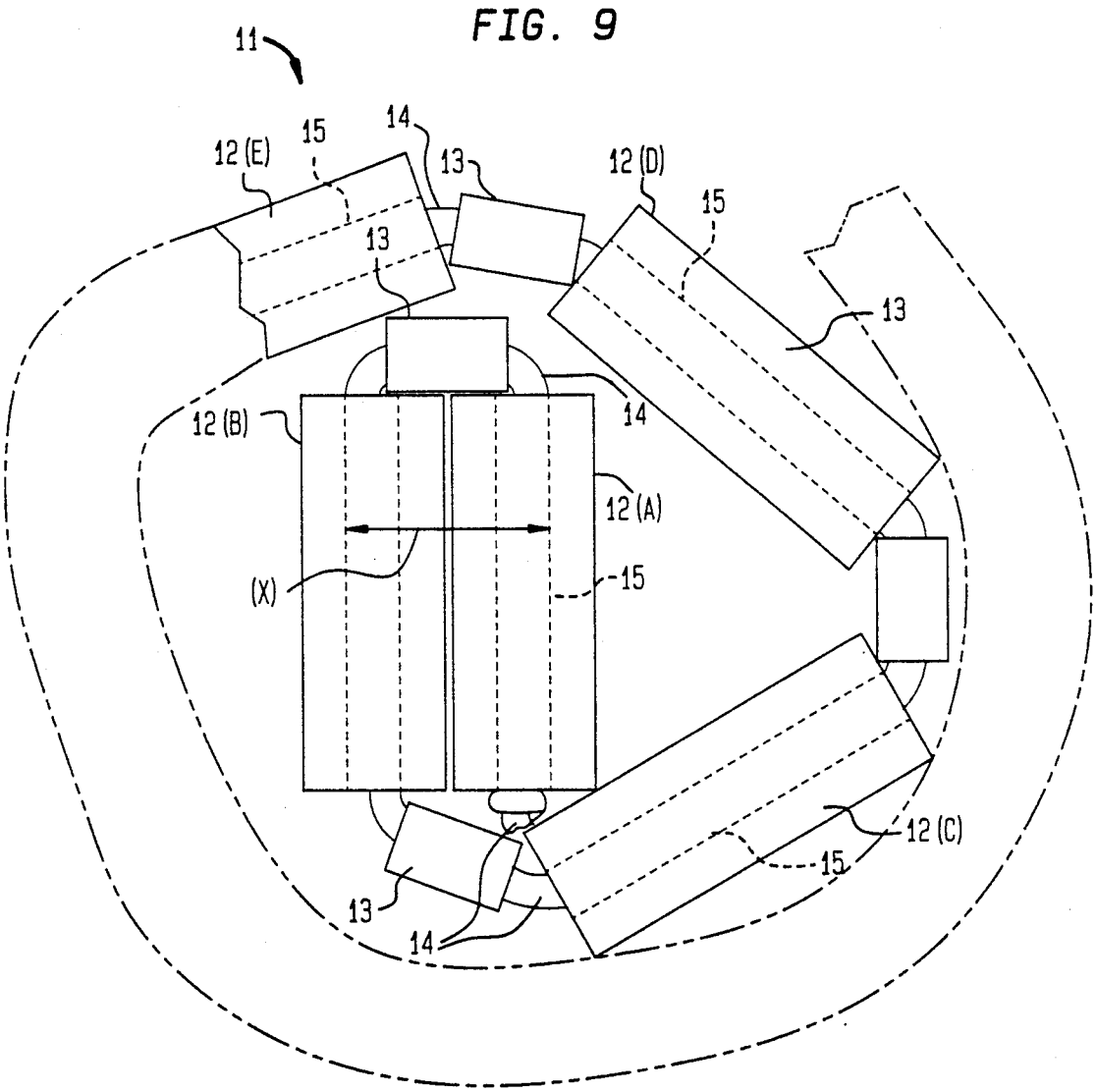

Another important feature of the present invention is the collapsibility of the assembly 11 for storage or for carrying. The assembly 11 may be rolled up on itself as illustrated in FIG. 9 or it may be folded into a neat stack as shown in FIG. 10. The assembly 11 in FIG. 9 shows the end bar 12(A) folded directly onto the second bar 12(B) and the other bars 12(C), 12(D), 12(E), etc. compactly rolled onto each other. To accomplish this, the spacer 13 plus twice the thickness of rope 14 must be substantially equal to the distance indicated by the double-headed arrow (X). Additionally, the ropes 14 must also be sufficiently elastic to stretch the required amounts as seen in FIG. 9. When rolled up as shown in FIG. 9, the assembly 11 forms a compact, generally cylindrical structure, making it easier to store and carry. It is appreciated that in some cases the size of the assembly 11 may be too large to carry. However, due to its compact, cylindrical shape, the assembly 11 may be conveniently moved about in most cases, by rolling it along the ground.

Figures 4, 8:
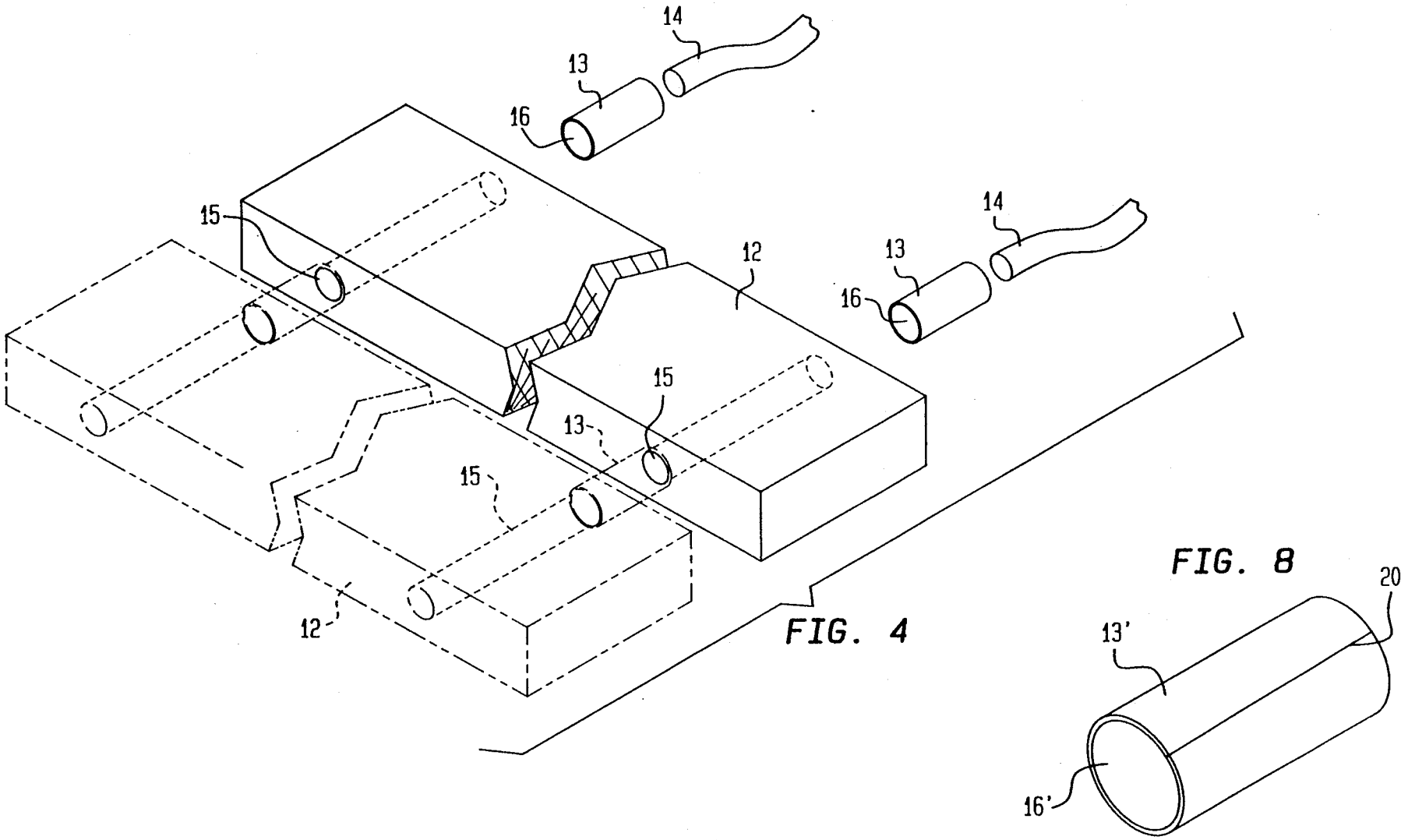
FIG. 4 is an exploded pictorial view of a portion of the preferred embodiment.
FIG. 8 is a pictorial view of a modified portion of the invention.

FIG. 8 illustrates a modified spacer 13′ having a longitudinal slit 20 and a rope-receiving bore 16′. The modified spacer 13′ is preferably made of a resilient material, such as plastic, so that the slit 20 may be manually spread open by a user for removing or replacing the spacers 13′ without having to rethread the ropes 14. The use of spacers 13′ will facilitate the assembly and/or easy changing of the configuration of the assembly 11. For example, if the assembly 11 is sold or stored in the normal shape shown in FIG. 1, a user may later readily modify the linear assembly 11 of FIG. 1 to look like the curved assembly 11 of FIG. 6. Using the spacers 13′, the change in shape may be accomplished by simply removing the appropriate spacers 13′ and readjusting the lengths of ropes 14.

Figure 11:
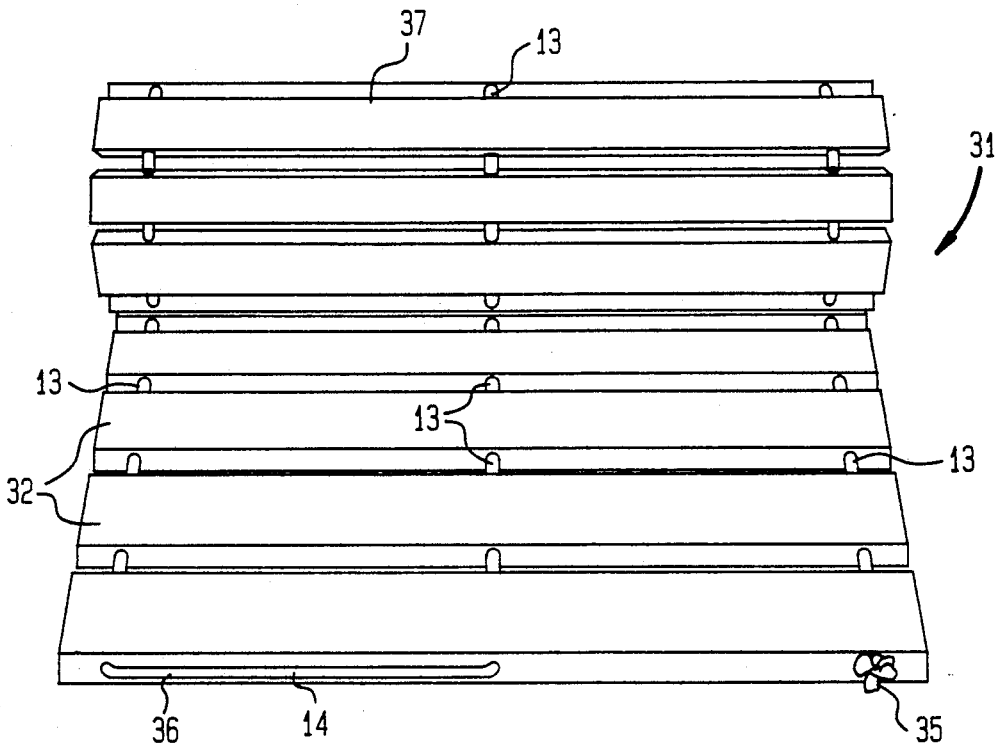
FIG. 11 is a pictorial view of an alternate embodiment in a partially rolled up configuration.

FIG. 11 shows a relatively wide assembly 31 that may be used to cover large areas to form a deck or the like. Assembly 31 is composed of rigid bars 32, similar to bars 12 of FIG. 1, each having three bores through which a rope 14 is threaded. Spacers 13 are mounted on the single rope 14 that is threaded between the bars 32. To thread rope 14, one end is first knotted at 35. The other end is then alternately threaded through the bores on the right side of bars 32 and the spacers 13. The rope 14 is then folded back (not shown) and threaded through the spacers 13 and the center bores of bars 32 and then folded back as at 36 to be threaded through the spacers 13 and the bores on the left side of bars 32. Finally, the rope 14 is pulled taut and knotted (not shown). The assembly 31 is shown partially rolled up at 37.

Figure 12:
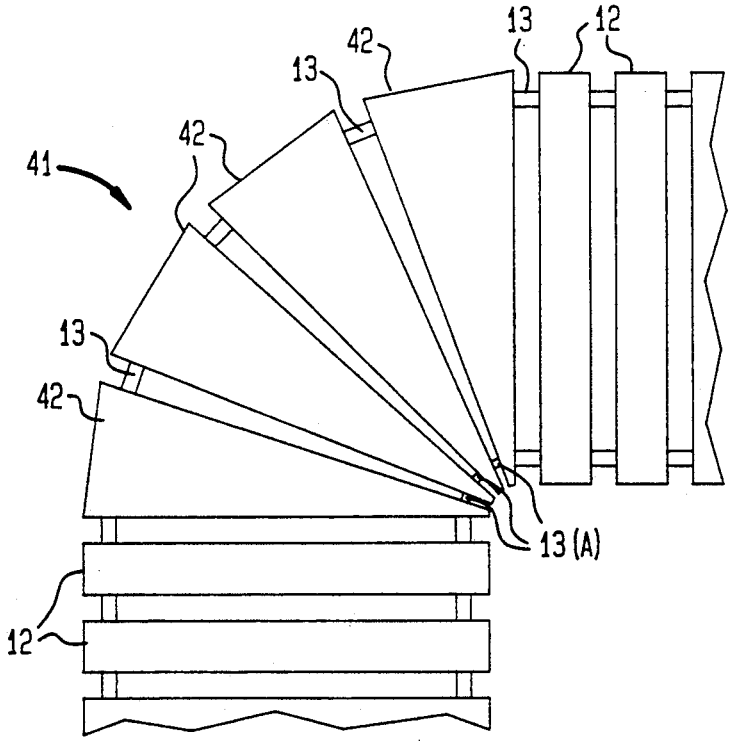
FIG. 12 is a top view, with portions broken away, of a further alternate embodiment.
Figure 13:
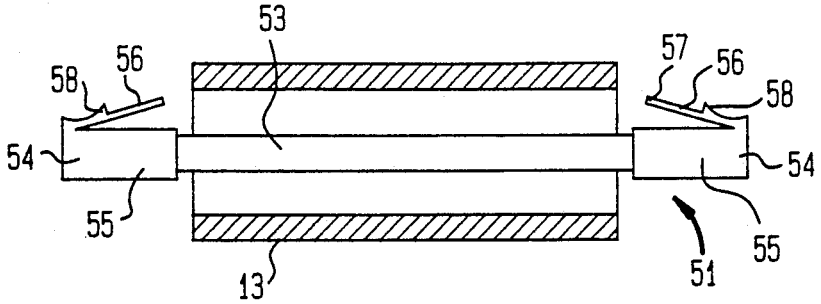
FIG. 13 is a side elevation, partly in section, of still another alternate embodiment.
Figure 14:
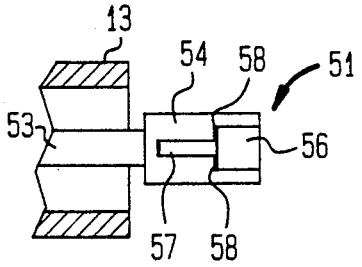
FIG. 14 is a top view, partly in section and broken away, of a portion of the device shown in FIG. 13.
Figure 15:
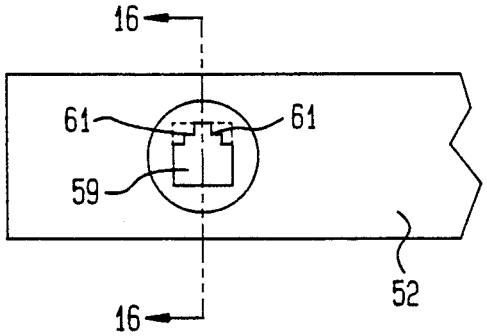
FIG. 15 is an elevation, partly broken away, of a portion of the invention to be used with the embodiments of FIGS. 13 and 14.
Figure 16:
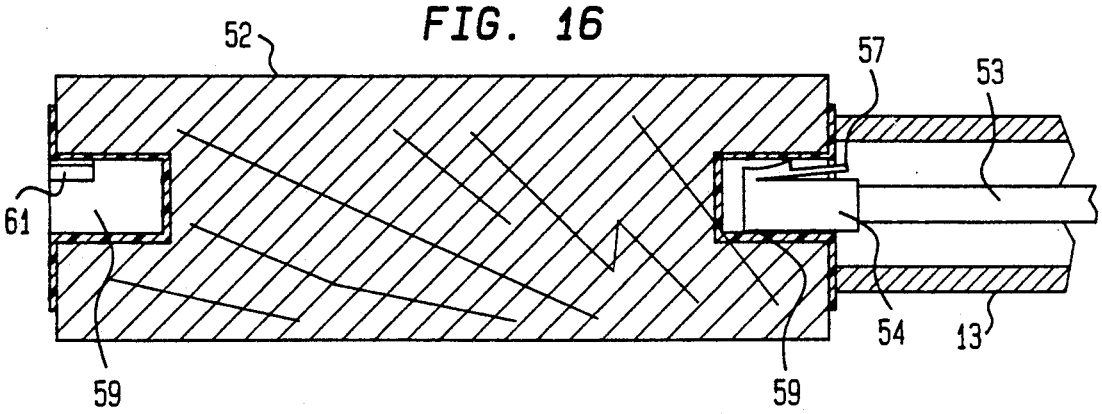
FIG. 16 is a section of the device shown in FIG. 15 taken on the line 16—16 and looking in the direction of the arrows.

FIG. 12 illustrates an assembly 41 having bars 12, as described with respect to FIG. 1, and a plurality of wedge-shaped bars 42 useful for creating an abrupt 90° turn. The bars 42 have bores at either end for receiving rope 14 (not shown). Spacers 13 are placed on the rope 14 except for a number of shorter spacers 13(A) that are shown mounted on the rope 14 between the narrow ends of bars 42.

FIGS. 13–16 illustrate a further modification of the invention wherein flexible interlocking elements 51 are used for joining adjacent bars 52 to form an assembly similar to the assembly 11 (FIG. 1). The interlocking elements 51 include a flexible line 53, which may be made of rope, with modular connectors 54 joined at either end. Connectors 54 include a body portion 55 having a resilient tang 56 joined thereto. Tang 56 includes a finger piece 57 and locking shoulders 58.

The bars 52 are prepared with short cavities into which locking bores 59 are fixed. Bores 59 have openings with shoulders 61 for receiving the connectors 54 when the tang 56 is pressed toward the body 55. Once completely inserted into the bores 59, the tang 56 can expand such that the locking shoulders 58 abut the inside surfaces of the shoulders 61. Further, the lines 53 may be made of different lengths for use in forming turns as shown in FIG. 7. The elements 51, being easy to install and remove, facilitate the making of kits for consumption by the general public.

Obviously many other modifications and variations of the present invention are possible in the light of the above teachings. For example, the assembly 11 may be laid on a surface to form a walkway or be laid over a frame to form a latticework or be stood on its edge to form a barrier. Still further, the assembly 11 may be rolled into a cylindrical shape and stood on its edge and used as a base support for a table top or the like. When used as a walkway, the edges of the bars 12 may be tapered and in some cases spiked anchors may be connected to the assembly 11 and be driven into the ground to prevent movement of the assembly with respect to the ground.

It is, therefore, to be understood, that within the scope of the appended claims, the invention may be practiced otherwise than as specifically described.

I claim:

1. An assembly of articulated members comprising:

a plurality of rigid bars, each said bar having at least two bores formed therein, said bores in said bars extending through said bars;

flexible connecting means extending between said bars and into said bores for articulating said bars with respect to each other, said flexible connecting means including at least one rope; and, a plurality of cylindrically shaped tubular spacers having axial bores, each of said spacers mounted on said connecting means between adjacent ones of said bars, wherein said connecting means extends through said bores in said bars and through said axial bores in said spacers.

2. The assembly of claim 1 wherein said rope includes means for holding said rope in tension such that said bars and spacers abut each other.

3. The assembly of claim 2 wherein one of said spacers is mounted on each of said ropes extending between each of said bars.

4. The assembly of claim 3 wherein some of said spacers have different lengths whereby said assembly forms a turning surface.

5. The assembly of claim 3 wherein the width of some of said bars varies across their length whereby said assembly forms a turning surface.

6. A supporting surface comprising:

a plurality of rigid bars having flat upper and lower surfaces;

spacer means mounted between said bars for holding said bars in a spaced relationship with respect to each other; and a flexible securing means passing through said bars and said spacer means for holding said bars in abutting relationship to said spacer means and for permitting said bars to be folded with said flat upper and lower surfaces superimposed on each other, wherein said bars are aligned along a winding path.

7. A supporting surface comprising:

a plurality of rigid bars having flat upper and lower surfaces;

spacer means mounted between said bars for holding said bars in a spaced relationship with respect to each other; and, a flexible securing means passing through said bars and spacer means for holding said bars in abutting relationship to said spacer means and for permitting said bars to be folded with said flat upper and lower surfaces superimposed on each other, wherein some of said spacer means have different lengths whereby said surface forms a turning surface.

8. A supporting surface comprising:

a plurality of rigid bars having flat upper and lower surfaces;

spacer means mounted between said bars for holding said bars in a spaced relationship with respect to each other; and, a flexible securing means passing through said bars and spacer means for holding said bars in abutting relationship to said spacer means and for permitting said bars to be folded with said flat upper and lower surfaces superimposed on each other.

wherein the widths of some of said bars varies across their length whereby said surface forms a turning surface.

9. An assembly of articulated members comprising:

a plurality of rigid bars, each of said bars having at least two bores formed therein, said bores in said bars extending through said bars;

elastic connecting means extending between said bars and into said bores for articulating said bars with respect to each other, said elastic connecting means including at least one rope; and, a plurality of cylindrically shaped tubular spacers having axial bores, each of said spacers mounted on said connecting means between adjacent ones of said bars, wherein said elastic connecting means extends through said bores in said bars and through said axial bores in said spacers.

10. An assembly of articulated members comprising:

a plurality of rigid bars, each of said bars having at least two bores formed therein, said bores in said bars extending through said bars;

flexible connecting means extending between said bars and into said bores for articulating said bars with respect to each other, said flexible connecting means including at least one rope; and, a plurality of spacers having a long dimension and a short dimension and including a bore extending through the long dimension of said spacer, each of said spacers mounted on said connecting means between adjacent ones of said bars, wherein said connecting means extends through said bores in said bars and through said bores in said spacers.

11. An assembly of articulated members comprising:

a plurality of rigid bars, each of said bars having at least two bores formed therein, said bores in said bars extending through said bars;

flexible, non-rigid securing means extending between said bars and into said bores for articulating said bars with respect to each other; and, a plurality of spacers having a long dimension and a short dimension and including a bore extending through the long dimension of said spacer, each of said spacers mounted on said flexible securing means between adjacent ones of said bars, wherein said flexible securing means extends through said bores in said bars and through said bores in said spacers.

* * * * *